US008480967B2

(12) United States Patent
Zlatic et al.

(10) Patent No.: US 8,480,967 B2
(45) Date of Patent: Jul. 9, 2013

(54) DISPENSING SYSTEMS WITH CONCENTRATED SOAP REFILL CARTRIDGES

(75) Inventors: Doug Zlatic, North Royalton, OH (US); Dean DeCarlo, Hudson, OH (US); Courtney Cooper, Streetsboro, OH (US)

(73) Assignee: GOJO Industries, Inc., Akron, OH (US)

( * ) Notice: Subject to any disclaimer, the term of this patent is extended or adjusted under 35 U.S.C. 154(b) by 347 days.

(21) Appl. No.: 12/847,324

(22) Filed: Jul. 30, 2010

(65) Prior Publication Data

US 2011/0027148 A1 Feb. 3, 2011

Related U.S. Application Data

(60) Provisional application No. 61/230,420, filed on Jul. 31, 2009.

(51) Int. Cl.
*B01D 12/00* (2006.01)

(52) U.S. Cl.
USPC ..... 422/266; 422/263; 422/264; 137/268; 137/605; 137/861; 222/133; 222/630

(58) Field of Classification Search
USPC ... 422/266, 263–264; 222/133, 630; 137/268, 137/605, 861
See application file for complete search history.

(56) References Cited

U.S. PATENT DOCUMENTS

| | | | | |
|---|---|---|---|---|
| 2,120,807 | A | 6/1938 | Kundel et al. | |
| 3,070,316 | A | 12/1962 | Miville et al. | |
| 3,134,545 | A | 5/1964 | Arniond et al. | |
| 5,549,875 | A * | 8/1996 | Laughlin et al. | 422/266 |
| 6,233,756 | B1 | 5/2001 | Holbrook, Sr. | |
| 8,065,758 | B1 * | 11/2011 | Mendez | 4/654 |
| 2010/0108714 | A1 * | 5/2010 | Bertucci et al. | 222/57 |

OTHER PUBLICATIONS

International Search Report & Written Opinion for International application No. PCT/US2010/043894; dated Feb. 6, 2012; 10 pages.

* cited by examiner

*Primary Examiner* — Brian R Gordon
(74) *Attorney, Agent, or Firm* — Renner Kenner Greive Bobak Taylor & Weber

(57) ABSTRACT

Soap dispensing systems are disclosed that employ concentrated forms of soap in order to permit the soap provider to decrease the costs associated with shipping soap to consumers. These dispensing systems are adapted to deliver both soap and rinse water, with the soap being delivered by dissolving or diluting a portion of the concentrated soap with water, and delivering the less concentrated soap to the user. In particular embodiments, the concentrated soap is provided in a disposable sanitary cartridge unit wherein all parts wetted with soap and carrying concentrated soap are disposable, to be replaced, when empty, with a new sanitary cartridge unit.

14 Claims, 8 Drawing Sheets

DISPENSING SYSTEMS WITH CONCENTRATED SOAP REFILL CARTRIDGES

RELATED APPLICATIONS

This claims priority from Provisional Application 61230420, filed Jul. 31, 2009.

FIELD OF THE INVENTION

The present invention generally relates to soap dispensing systems. More particularly, the present invention relates to a soap dispensing system employing a highly concentrated soap cartridge refill. In accordance with particular embodiments, the highly concentrated soap cartridge refill might be incorporated into a faucet or a water filtration system or might be retro-fitted to common soap dispensers.

BACKGROUND OF THE INVENTION

In the current political and economic climate, there is drive across various industries to reduce the environmental impact of product manufacturing and use and other business practices. There is also a drive to service economically disadvantaged countries, not only in the pursuit of profits, but in the pursuit of the well being of the inhabitants of those countries. Business models that are successful in both reducing environmental impact and servicing disadvantaged countries are of extreme benefit to the world.

One way to reduce environmental impact is to reduce the "carbon footprint" of the operations of an industry. The "carbon footprint" is generally understood as being related to the amount of carbon-based fuels employed in carrying out the functions of a given industry. In light of the fact that most current energy sources having practical utility are carbon-based, all manner of production and transportation, including product transportation, increase an industry's carbon footprint.

With respect to the soap dispensing industry, which, in accordance with this disclosure, is to include both the provision of soap dispensers and the provision of soap to fill those dispensers, the amount of carbon-based energy employed to ship soap products could be significantly reduced to thereby reduce the carbon footprint of the soap-dispensing industry. Particularly, soap dispensers are typically designed with dispenser housings that receive either a bulk supply of soap or what are known as "refill units" of liquid-based soap, the refill units including a container of liquid-based soap and a pump mechanism that is actuated to advance a dose of fluid from the container toward the ultimate dispenser outlet. In the dispensers employing refill units, the dispenser housings are provided as generally permanent structures at given locations, while the refill units of liquid-based soap are disposable products that must be constantly shipped to the location of these dispenser housings to replace empty refill units as the soap therein is depleted. Because the active ingredients of the soap are incorporated into water or other liquids, the liquid-based soap product is quite heavy and voluminous. This means that the transportation of such liquid-based soaps will require significant amounts of energy per a given amount of cleaning utility offered by the soap. This contributes to the carbon footprint of the industry and, thus, there is a need in the art to provide more concentrated soaps that are capable of providing an acceptable level of cleaning utility, while being of relatively low weight and volume, thereby reducing the energy expended in transporting them as compared to highly liquid-based, less concentrated soaps of the prior art.

The significant weight of water-based soaps also currently makes it uneconomical to ship to economically disadvantaged countries. Particularly, those countries might not be able to afford the water-based soaps in light of the built-in costs relating to the transportation thereof. Thus, by providing concentrated soaps and dispensers for concentrated soaps, it might be possible to reduce shipping costs sufficiently to successfully market and provide soap and dispensers to economically disadvantaged countries.

In order that the concentrated soaps are well-received, the art must also provide a desirable dispenser system employing such concentrated soaps, and the present invention is directed to this need.

SUMMARY OF THE INVENTION

In accordance with one embodiment, the present invention provides a soap dispensing system for personal hygiene. The soap dispensing system includes a water supply that provides water to the system. The system further includes a soap outlet, a rinse water outlet, a soap conduit, a rinse water conduit, a soap chamber communicating with the soap conduit and holding concentrated soap, and flow controller. The flow controller controls the flow of water provided by the water supply. In a soap dispensing operation, the flow controller causes the water to flow to dissolve or dilute concentrated soap from the soap chamber to create a less concentrated soap that is then delivered to the soap outlet through the soap conduit. In a water dispensing operation, the flow controller causes water to flow through the rinse water conduit to deliver rinse water to the rinse water outlet. The rinse water conduit and the soap conduit are separate and distinct such that the rinse water conduit never carries soap.

DETAILED DESCRIPTION OF ILLUSTRATIVE EMBODIMENTS

Figure 1:
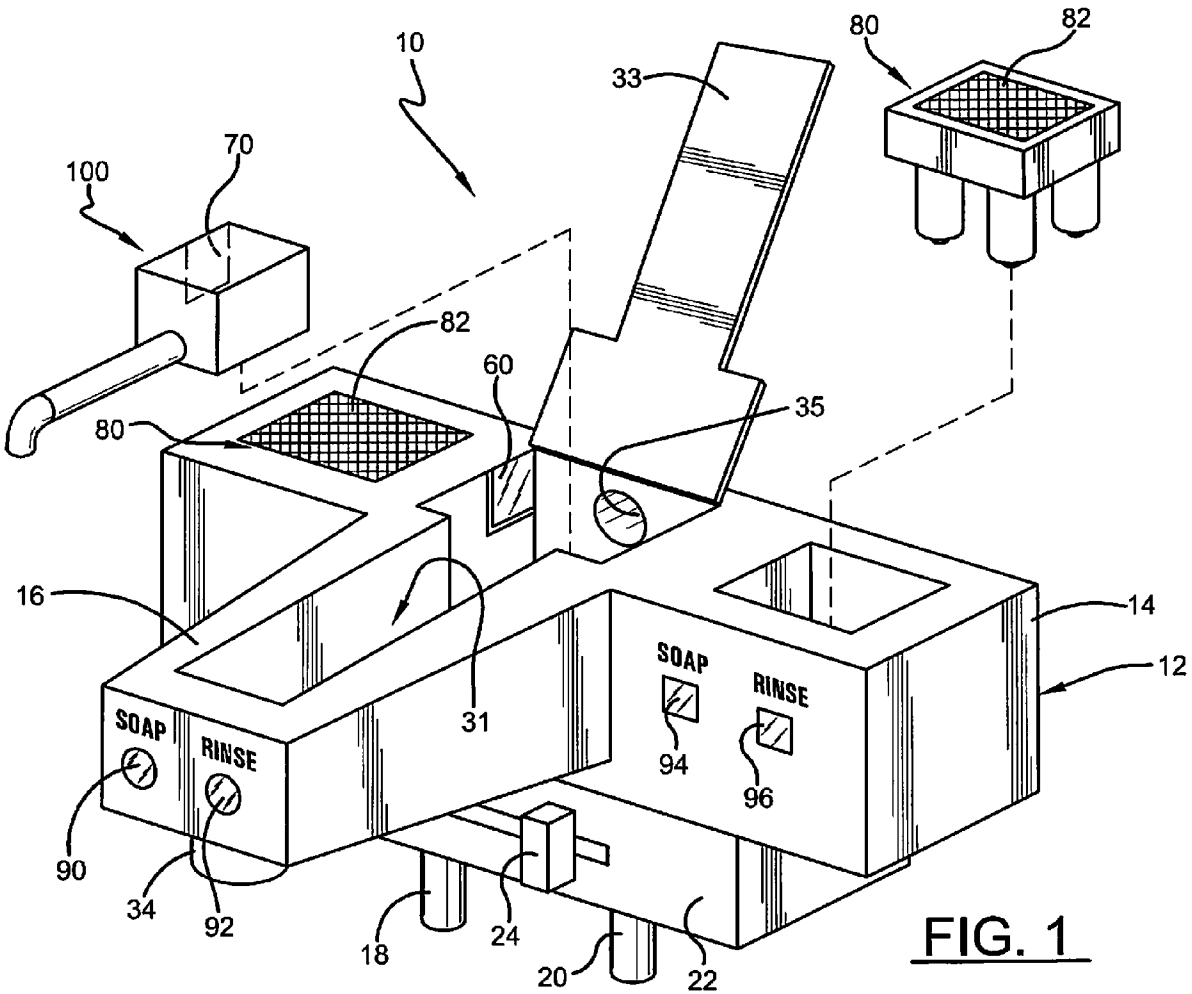
FIG. 1 is a perspective view of an dispensing system wherein a sanitary soap cartridge containing a concentrated soap is received in a faucet, the embodiment including optional features providing additional utility.
Figure 2:
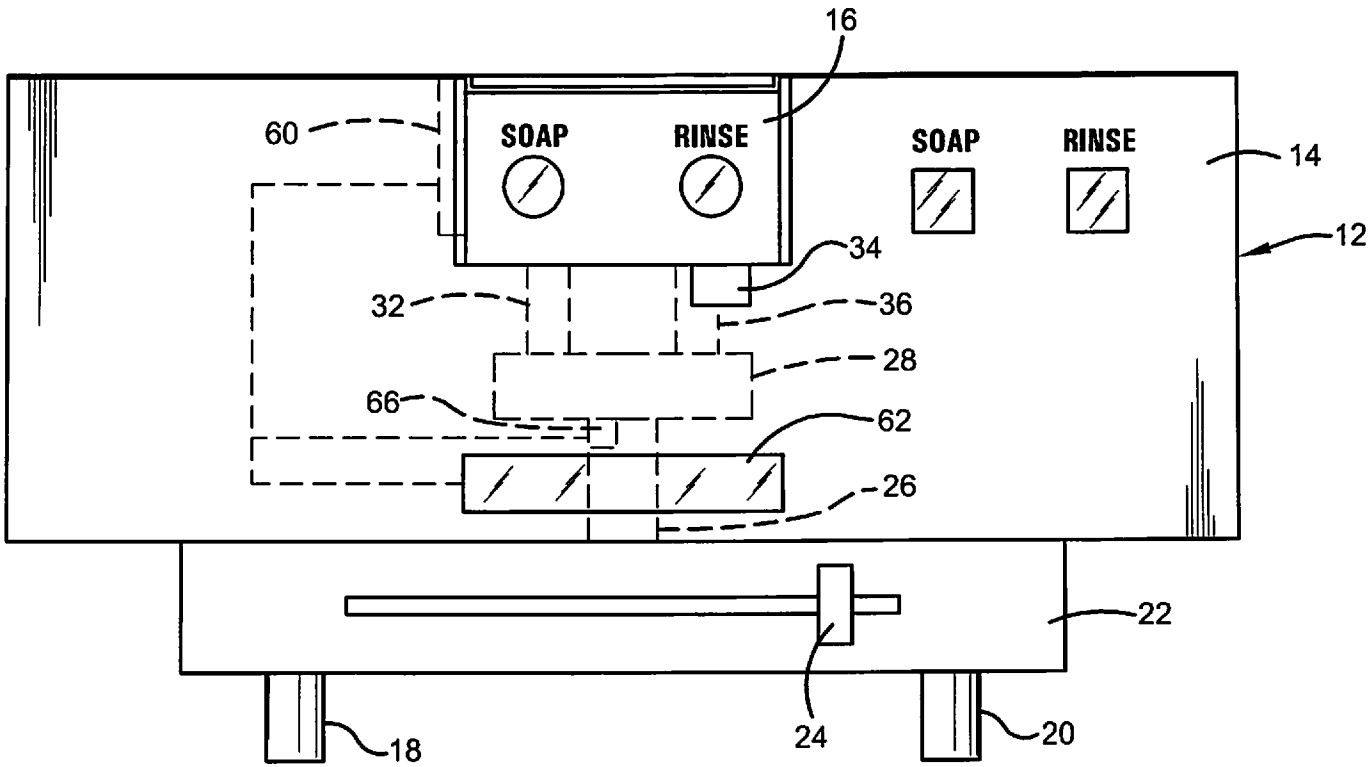
FIG. 2 is a front elevation view of the dispensing system of FIG. 1.

Referring now to FIGS. 1 and 2, a first embodiment of a dispensing system employing a concentrated soap is shown and designated by the numeral 10. In accordance with this invention, the dispensing system 10 is actuated either manually by manipulation of provided buttons, knobs and the like or electronically by the tripping of a touchless sensor or sensors. An initial actuation dilutes or dissolves the concentrated soap to deliver a less concentrated soap to the end user for use in personal cleaning, and a subsequent actuation delivers rinse water to the end user for rinsing away the soap.

The dispensing system shown here is a counter mounted system (also know as a deck mounted system), but it should be appreciated that the concepts disclosed herein could be practiced in wall mounted dispensers and other environments.

Particular embodiments will be disclosed for different types of concentrated soaps and different means for incorporating a discrete amount of the concentrated soap into water to deliver a less concentrated soap to the end user for use in washing. The concentrated soaps herein are solid or liquid. In particular embodiments, the soaps can be solid blocks of soap or solid soaps having some degree of porosity. In other embodiments, the soaps can be powdered soaps. In yet other embodiments, the concentrated soaps are liquid soaps.

The dispensing system 10 includes a faucet 12 that is configured to separately deliver both a diluted soap product and rinse water to an end user. Faucets are very well known, and the particular type of faucet 12 is simply one example. The faucet 12 of this embodiment includes a base body 14 from which extends a spout 16. The spout would typically extend over a sink basin (not shown) in a common manner, though at least the embodiment of FIG. 7 herein does not include a sink basin. The base body 14 houses many of the components of this embodiment; however, it should be understood that these components could be otherwise mounted near a faucet of a different style, for example, a faucet that is, for the most part, characterized merely by a spout portion. In such a case, many of the other components of this system might be mounted underneath or within the counter to which the spout is mounted.

In this particular embodiment, the body portion 14 houses or provides fitments 18 and 20, which receive incoming lines of hot and cold water, as generally known. In this embodiment, the fitment 18 is a hot water fitment, while the fitment 20 is a cold water fitment. It should, however, be appreciated that, particularly in economically disadvantaged countries, such a hot water inlet might not be provided at a desired location for the dispensing system 10. Thus, it should be readily appreciated that, while a water source and inlet into the dispensing system 10 is required, it is not necessary that there be both a hot and cold water supply.

When there is both a hot and cold water supply, as in the embodiment of FIGS. 1 and 2, a temperature adjustment manifold 22 is preferably employed to permit the end user to adjust the temperature of the water coming out of the spout 16, for example by adjusting hot and cold water knobs (not shown), as is generally practiced with common sinks. The temperature adjustment manifold 22 could also be associated with a single knob or lever that will mix and dispense varying amounts of hot and cold water in accordance with the positioning of that knob or lever, again, as generally known in the art. In a completely touchless system, wherein the user would not be required to manipulate knobs, but would instead trip a sensor by placing a hand in an appropriate location, the manifold 22 could be preset to deliver water of a desired temperature. Alternatively, a regulator 24 could be manipulated to adjust the ratio of hot water to cold water mixed at the manifold, thus permitting the system owner (or other individuals) to adjust the temperature of the water delivered in such a touchless system.

In the embodiment shown in FIGS. 1 and 2, an initial actuation of the dispensing system is intended to deliver a less concentrated soap to the end user by dissolving or diluting a portion of a concentrated soap with water and delivering it to the system outlet. This invention provides multiple replaceable sanitary soap cartridges that can be employed as part of the dispensing system to deliver a concentrated soap into the flow path of the water. The embodiment of FIG. 1 shows the use of a disposable sanitary soap cartridge 100 containing a concentrated block of soap 104 (FIG. 3), but it is specifically noted here that other cartridges disclosed herein can be employed in the embodiment of FIG. 1, in accordance with the teachings herein. As seen in FIGS. 1 and 2, the water flowing from the manifold 22 flows through a pipe 26 that leads to a flow controller 28 consisting of a valve or valves and/or other mechanisms sufficient to selectively feed the water to either the soap cartridge 100 (or any other cartridge herein disclosed), through a pipe 32, or to a water outlet 34, through a rinse conduit 36. The pipe 32 may be considered a cartridge water delivery pipe because it serves to deliver water to a portion of the cartridge in different embodiments herein. For simplicity, it is referred to as a pipe 32 throughout this disclosure.

Figure 3:
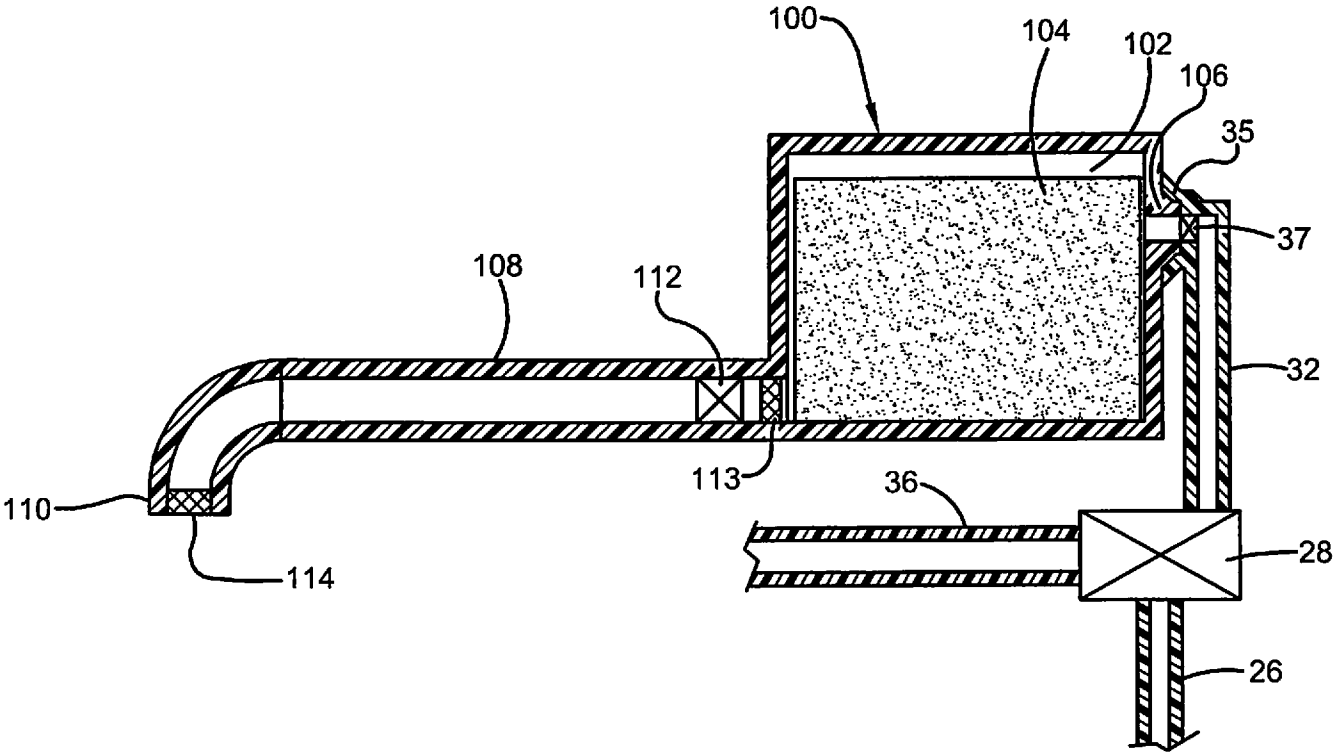
FIG. 3 is a schematic view of a sanitary soap cartridge embodiment wherein water flows into the soap cartridge to dissolve or dilute the concentrated soap so that the soap can be delivered to the end user.

The soap cartridge 100 is shown in more detail and its interaction with the faucet 12 is schematically represented in FIG. 3. The soap cartridge 100 provides a soap chamber 102 that holds a solid concentrated soap block 104. The soap cartridge 100 is a disposable article that is selectively received in a cartridge receptacle 31, which is accessed by opening a receptacle cover 33 communicating with the spout 16 and body 14 (though it could be otherwise located). The soap cartridge 100 includes an inlet nozzle 106 that provides a water inlet into the soap chamber 102, and a soap conduit 108 that provides a soap outlet 110 for the soap dissolved by water flowing through the soap chamber 102. An outlet valve 112 can be employed to separate the soap chamber 102 from the soap conduit 108. To address requirements that steps be taken to avoid the backflow of soap into the water supply, either the flow controller 28 could be configured with appropriate valves a backflow valve 37 could be employed in pipe 32 to prevent soap from entering pipe 26 and rinse water conduit 36. Double o-rings, duckbill valves, ITT quick connects and the like will be found suitable for this purpose. When received in the cartridge receptacle 31, the inlet nozzle 106 engages a port 35 provided in the cartridge receptacle 31, and the soap conduit extends along the length of the spout 16 to provide the soap outlet 110 at the distal end thereof, as generally known, and as shown for water outlet 34 of rinse conduit 36. The nozzle 106 engages the port 35 in a water-tight manner to prevent any leakage.

During a soap dispensing operation, the flow controller 28 feeds the water to pipe 32, and the water enters the soap cartridge 100 through the inlet nozzle 106, flows over, around, or through (or otherwise appropriately contacts) the soap block 104 before exiting the soap chamber 102 at the outlet valve 112. A screen 113 may be placed in front of the outlet valve 112 to prevent solid soap particles that might break off of the soap block 104 from exiting the soap chamber 102. The soap block 104 is of a type that will be dissolved by the water, such that a less concentrated soap exits the soap cartridge 100, travels down soap conduit 108 and is ultimately delivered to the soap outlet 110.

Figure 3B:
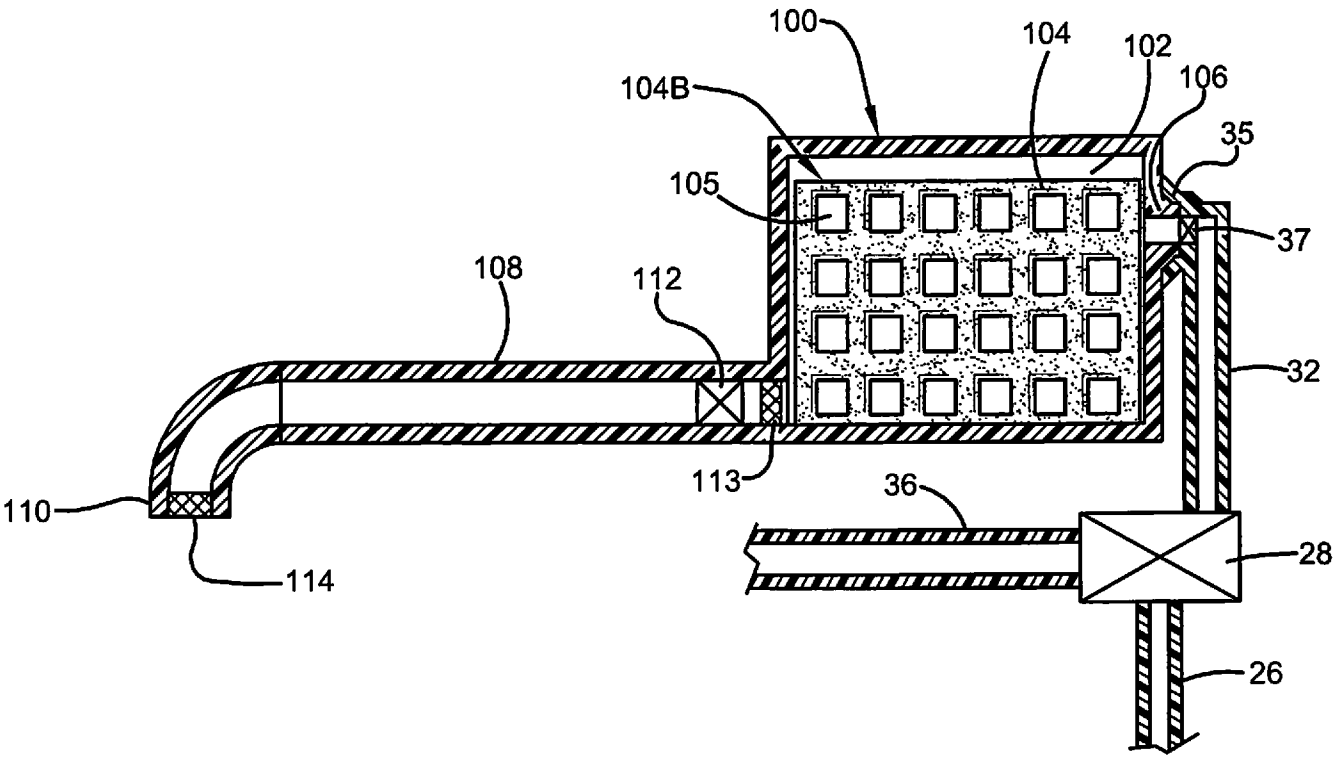
FIG. 3B is a schematic view similar to FIG. 2, but showing an alternative soap formed with porosity to facilitate the dissolving of the soap into water.

The soap block 104 may in some embodiments be altered to provide some degree of porosity through which the water flows to facilitate dissolving of the soap. This is shown in FIG. 3B, wherein a soap block 104B is shown with a lattice matrix as represented at the pores 105 therein.

Figure 4:
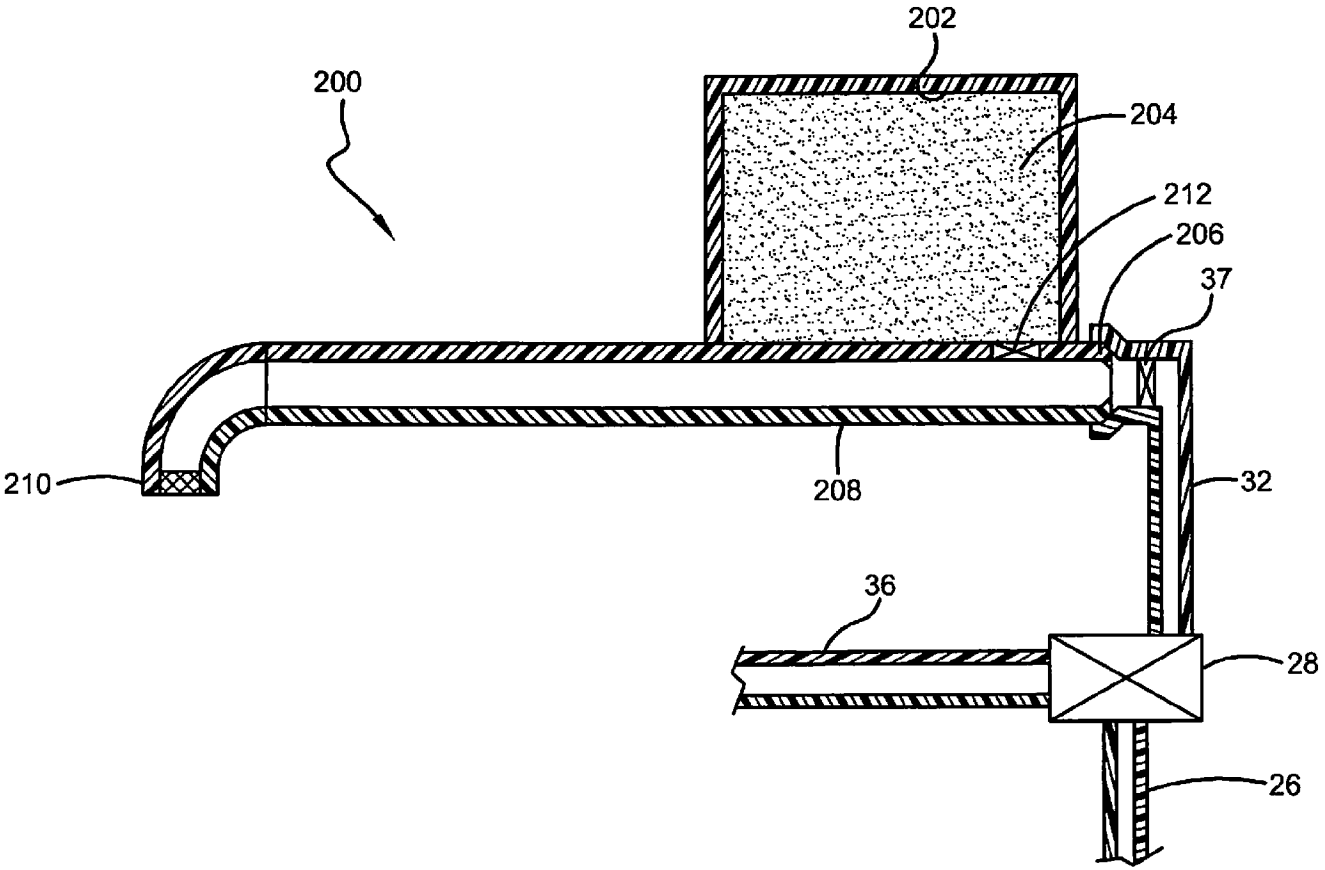
FIG. 4 is a schematic view of a sanitary soap cartridge embodiment employing a powdered soap.

In FIG. 4, an embodiment employing a concentrated powdered soap is shown. In this embodiment, a concentrated powdered soap cartridge 200 replaces the solid concentrated soap cartridge 100 that held the concentrated soap 104 in the previously-disclosed embodiment. The flow lines are also slightly modified, as disclosed below and shown in FIG. 4, though other aspects of this embodiment remain identical to those of the embodiment of FIGS. 1 and 2. The soap cartridge 200 holds a powdered concentrated soap 204 in the soap chamber 202, and a discrete amount of the powdered soap 204 can be delivered to the soap conduit 208 through a dosing valve mechanism 212. The soap conduit 208 fluidly communicates with the pipe 32, and, in some embodiments, may do so through a valve 37 to prevent backflow that might permit the soap to reach flow controller 28. Because the flow of water through the pipe 26 is stopped by the flow controller 28, water is prevented from entering the pipe 32 toward the cartridge 200. When soap is requested, a soap dispensing operation occurs in which the dosing valve mechanism 212 deposits a dose of powdered concentrated soap 204 into the soap conduit 208, and, once the dosing valve mechanism 212 is back to a rest state, the flow controller 28 opens the flow of water into pipe 32 to permit water to flow through soap conduit 208 and dissolve the powdered soap that was deposited therein. If the valve 37 is interposed between the pipe 32 and the soap conduit 208, it will, of course, also have to open to permit water to flow through the soap conduit 208. The water is isolated from the dosing valve mechanism 212 when powdered soap is being deposited in order to prevent the dosing valve mechanism 212 from being clogged by the agglomeration of wetted powdered soap. The soap is ultimately delivered to the soap outlet 210 of the faucet through the soap conduit 208.

Figure 5:
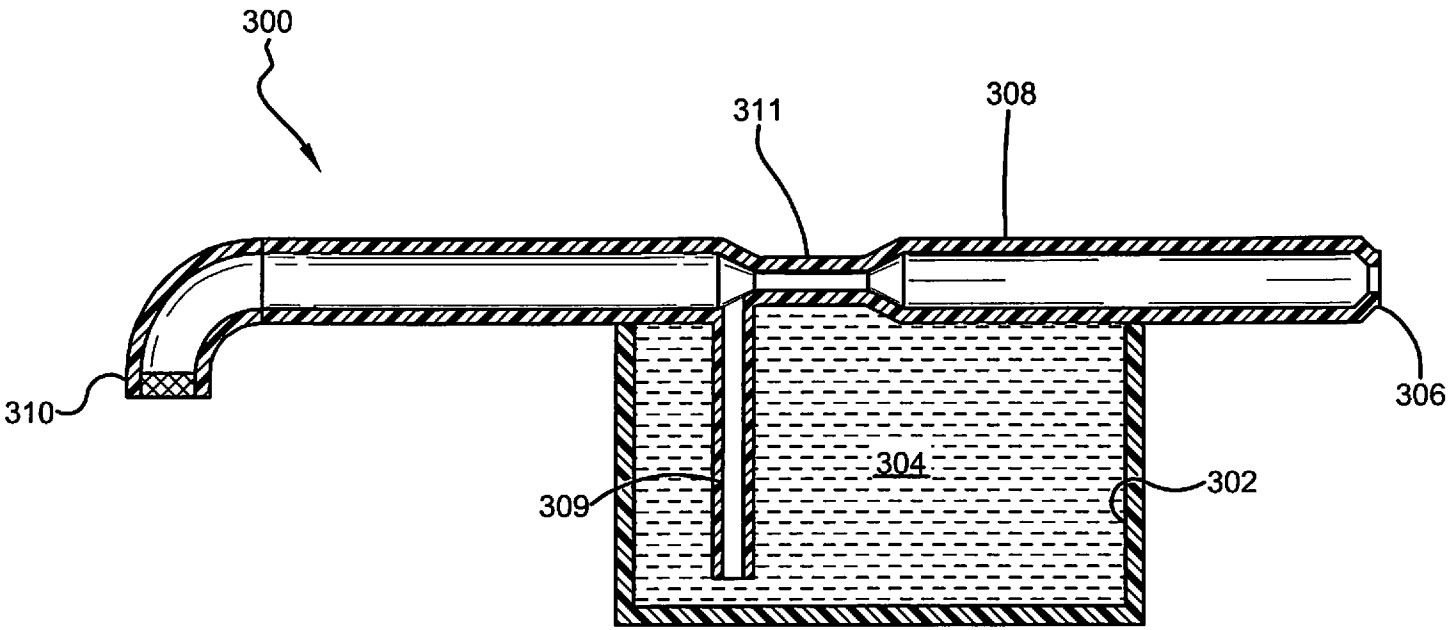
FIG. 5 is a schematic view of an alternative sanitary soap cartridge embodiment employing a concentrated liquid soap.

A sanitary concentrated liquid soap cartridge is shown in FIG. 5, wherein the cartridge is designated by the numeral 300, and its interaction with the faucet 12 is schematically represented. The soap cartridge 300 provides a soap chamber 302 that holds a concentrated liquid soap 304. The soap cartridge 300 is a disposable article that is selectively received in the cartridge receptacle 31, as already disclosed with respect to cartridge 100. The soap cartridge 300 includes an inlet nozzle 306 that provides a water inlet through a venturi tube 308 that communicates with the contents of the soap chamber 302 through a dip tube 309 and, like tube 108 of the cartridge 100, serves as the soap conduit. The venturi tube 308 extends to provide a soap outlet 310 for the soap once it is drawn into tube 308 and diluted. The venturi tube 308 extends along the length of the spout 16 to provide the soap outlet 310 at the distal end thereof, as generally known, and as shown for water outlet 34 of rinse conduit 36.

The venturi tube 308 provides a narrow conduit section 311 shown here bounded by a decreasing ID (inner diameter) section 313 and an increasing ID section 315. The dip tube communicates with the venturi tube 308 at the increasing ID section 315. When the flow controller 28 feeds the water to pipe 32, the water enters the venturi tube 308 through the inlet nozzle 306, and flows through the narrow conduit 311. As water flows through the increasing ID section 15, past the dip tube 309, a portion of the soap 304 is drawn up the dip tube and into the venturi tube 308 due to the Venturi effect. The concentrated liquid soap 304 is diluted by the flowing water such that a less concentrated soap exits the soap cartridge 300 through the venturi tube 308 and is ultimately delivered to the soap outlet 310.

While it is envisioned that the dispensing system 10 can be controlled manually through user-controlled knobs or buttons and the like, the embodiments disclosed herein are controlled by a dispenser controller 60 and sensor 62, which can be mounted in the faucet 12, as shown in FIG. 2, or can be otherwise located, as desired. The sensor 62 serves to sense the presence of a user's hand and send appropriate signals to the controller 60. The controller 60 includes appropriate hardware, software and memory to control the flow of water and the mechanisms that permit the incorporation of the soap into the water. Particularly, the controller 60 is programmed to receive requests for soap delivery and requests for rinse water delivery, and, upon such requests, the controller 60 appropriately actuates the flow controller 28 and opens valves (if and as necessary) to deliver either the soap or rinse water to the end user.

In embodiments employing the solid concentrated soap cartridge 100, when a request for soap delivery is received, the controller 60 will send an appropriate signal to the flow controller 28 to permit an appropriate amount of water to flow into the soap chamber 102 to contact the solid concentrated soap block 104 so that soap is dissolved by the water and delivered to the end user's hand through the soap conduit 108 and the soap outlet 110 of the faucet 12. When a rinse water request is received in this embodiment, the controller 60 will send an appropriate signal to the flow controller 28 to deliver rinse water to the end user through the rinse conduit 36 and the water outlet 34. The rinse water is intended to be free of soap, so the flow controller and pipes are appropriately configured to cause the water to carry and provide soap when a soap request is made, and to cause the water to bypass the soap source when a rinse water request is made. This can be accomplished by employing the disclosed separate flow paths for the soap and the rinse water.

In embodiments employing the concentrated powdered soap cartridge 200, when a request for soap delivery is received, the controller 60 will send an appropriate signal to the flow controller 28, the dosing valve mechanism 212 and the valve 37 (if employed) to permit an appropriate amount of the concentrated powdered soap 204 to be deposited in the soap conduit 208 and thereafter be dissolved and delivered to the end user's hand through the soap conduit 208 and the soap outlet 210. When a rinse water request is received in this embodiment, the controller 60 will send an appropriate signal to the flow controller 28 to deliver rinse water to the end user through the rinse conduit 36 and the water outlet 34.

In non-manual embodiments, the request for soap delivery and the request for rinse water delivery are dictated by the sensor 62. The user places his hand or hands under the distal end of the spout 16, and the presence of the hand(s) is registered by the sensor 62. As generally known, the sensor 62 includes a signal-sending means and a signal-receiving means, and the presence of an individual's hand at the appropriate location prevents the signal receiving means from receiving the signal sent from the signal-sending means, such that the system is actuated. These and other touchless sensors are well-known in the industry, and any suitable sensor can be employed. The sensor 62 is associated with the controller 60, such that, when the sensor 62 detects the presence of a hand, the controller 60 will cause the water to receive concentrated soap from sources and in a manner such as those already described above.

After receiving soap, the user can employ it to wash up as is common, and thereafter the user will need rinse water to finish washing up. In this particular embodiment, the delivery of the rinse water is controlled by the controller 60 and the sensor 62. Particularly, the controller 60 and associated hardware and software are programmed such that a first tripping of the sensor 62 delivers soap at soap outlet 110, and a subsequent tripping of the sensor 62 causes the controller 60 and associated hardware and software to cause rinse water to be delivered to water outlet 34. In such an embodiment, the user might be required to remove his hands from the area monitored by the sensor 62 after receiving the soap, to thereafter replace his hands in that area to trip the sensor 62 a second time to receive the rinse water. As another alternative, the controller 60 could be programmed to deliver rinse water after a set period of time after delivering the soap. For example, the controller 60 could be programmed so that, after the soap is delivered, the system waits 5 or 10 seconds (or any other desired amount of time) before automatically delivering the rinse water to the water outlet 34. This would give the user 5 or 10 seconds to use the soap, and the user would not have to remove his hands from the sensor area and then replace them to signal the need for rinse water. The rinse water request could be initiated simply by leaving the hands under the outlets 34 and 110. A soap indicator light 90 can be provided to light up when soap is being delivered, and a rinse indicator light 92 could be provided to light up when rinse water is being delivered.

As an alternative, in a manually-actuated embodiment, a soap-delivery button 94 (or knob or the like) could be provided and appropriately labeled to advise the user that soap will be delivered upon pressing the button (or turning the knob). Similarly, a water-delivery button 96 (or knob or the like) could be provided and appropriately labeled to advise the user that rinse water will be delivered upon pressing the button (or turning the knob). This would permit the user to select whether to receive soap or just rinse water, as desired.

In one embodiment, the soap outlet 110 is configured to deliver the soap in the form of a spray, because the spraying of the soap will cause the soap to foam up, thus giving the end user a visual verification that they have received soap, and not just rinse water. Thus a spray nozzle may optionally be employed at the soap outlet 110 (or 210). Instead of a spray nozzle, a screen or multiple screens might be placed in the outlet path before the soap outlet 110, with the screen(s) serving to foam the soap. The optional spray nozzle and screen are both to be understood as being represented in FIG. 3 at 114.

In one or more embodiments, the controller 60 can also be associated with a pressure monitor 66 in the pipe 26 to shut down the system if there is either no water pressure or insufficient water pressure. For example, if the water source is compromised and no water is flowing though the system, this shut down by the controller 60 will prevent actuation of the system and thus prevent concentrated soap from being injected into a non-existent water stream. This could be particularly beneficial in the concentrated powdered soap embodiment, where powdered soap could build up in the soap conduit 108 if not rinsed away by water.

In other embodiments, the controller 60 can be preprogrammed to control the operation of the system 10 in accordance with a signal received from the particular soap cartridge mounted therein. As shown by way of example in FIG. 1 with respect to the soap cartridge 100, the soap cartridges, whether cartridge 100, 100B, 200 or 300 can be configured with a signal-emitting device 70 that would send a signal to the controller 60. The controller 60 could be preprogrammed to recognize various signals, with each signal being associated with a particular desired dose of soap. This will be particularly useful where the type of concentrated soap being loaded into the system 10 via the soap cartridges might change. By employing this programming concept, the amount of product dispensed will be a direct result of the signal generated by the signal-emitting device 70 and the programming of the controller 60. For example, if a concentrated mechanic's soap cartridge is employed, the signal might cause the controller 60 to control the flow of water to permit a relatively large dose of the mechanic's soap product to be incorporated into the water. It will be appreciated that different soaps and different end uses (different cleaning needs) might require different doses of soap, and this would provide a means to cause an automatic alteration of the dose simply by altering the signal-emitting device carried by a cartridge. This concept might also be employed to ensure that only the appropriate type of soap cartridge is inserted into a given dispensing system, in that the controller 60 could be programmed to only permit operation of the system 10 if a particular signal is received from the signal-emitting device 70 of the soap cartridge.

Figure 6:
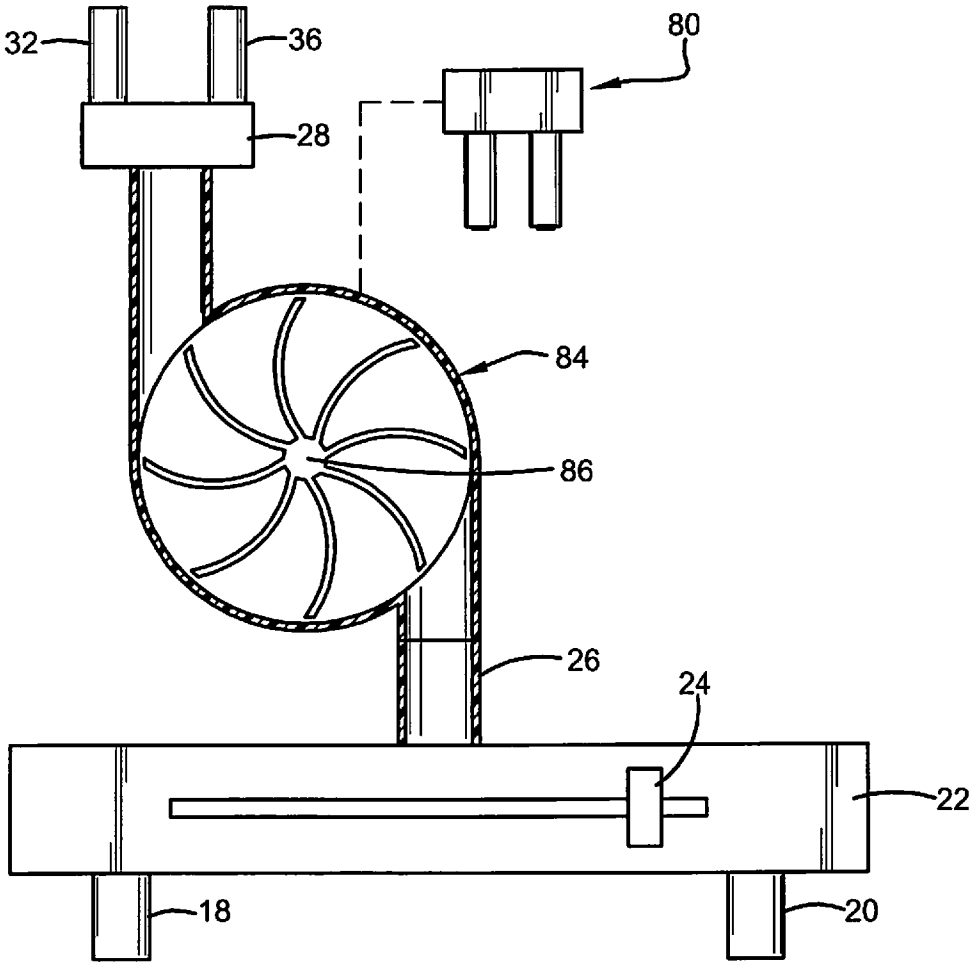
FIG. 6 is a schematic representation of a concept for charging batteries used to operate some of the components of the dispensing system.

Although in some embodiments the dispensing system 10 might be powered by a mains power supply, in other embodiments, it is envisioned that the dispensing system 10 would be powered by batteries 80. Though it may be acceptable to simply employ batteries and replace them as needed, in this particular embodiment, the batteries 80 are rechargeable. In FIG. 1, the batteries 80 are shown with a solar cell array 82, and the batteries can be charged through solar power. In the schematic of FIG. 6, an alternative concept is shown in which an optional water-driven generator 84 is employed to supply power to the rechargeable batteries. The water-driven generator 84 would include a turbine 86 communicating with the pipe 26 so that the water flowing through the dispensing system 10 would cause the water-driven generator 84 to supply power to the rechargeable batteries 80. The controller 60 would also be programmed to alert personnel when batteries are low or when the volume of concentrated soap is low in the concentrated soap source employed.

Figure 7:
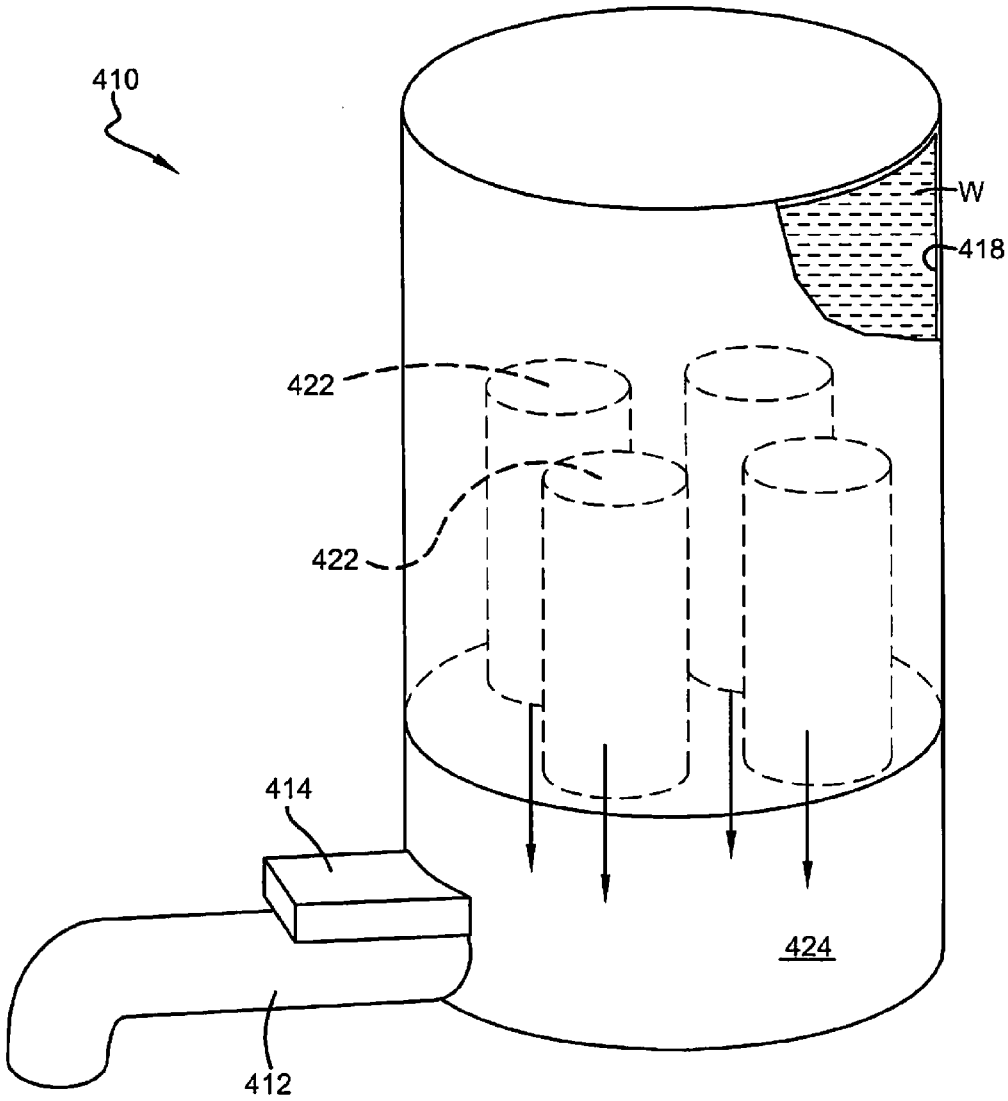
FIG. 7 is a general schematic view of a dispensing system wherein a concentrated soap is received in a filtration system such that the filtration system can deliver both soap and rinse water.

In yet another embodiment shown in FIG. 7, a majority of the above concepts are incorporated into a gravity filtration dispensing system 410 at the outlet faucet 412 thereof. In this embodiment, no hot or cold water sources are employed. Instead, dirty water W is placed into an upper compartment 418, and this water travels through a plurality of filters 422 to then reach a lower compartment 424, as represented by the arrows in FIG. 7. The filters 422 remove contaminants from the dirty water W as generally known in the art of water filters, and the water at lower compartment 424 is therefore clean. By opening a valve (not shown) on the faucet 412, clean water can be gravity-fed to the outlet of the faucet 412. This invention improves upon such filtration systems by including a body portion 414 in faucet 412 to receive soap cartridges such as those disclosed above. Body portion 414 can also include any desired or necessary batteries or controllers such as batteries 80 and controller 60 already disclosed, and the actuation of the system 410 can follow the options already disclosed as well. Having disclosed the system 10 of FIG. 1 in great detail, its incorporation into a gravity filtration dispensing system should be readily appreciable. This gravity filtration dispensing system 410 might be very useful in economically disadvantaged countries, particularly where running water is scarce or non-existent. In that regard, it should be appreciated that manually operated embodiments might be preferred for cost reasons in economically disadvantage countries.

The present invention provides advances in the art by providing means to permit the shipping of concentrated soaps that are capable of providing an acceptable level of cleaning utility, while being of relatively low weight and volume. This reduces shipping costs and may do so sufficiently to successfully market and provide such concentrated soap and dispensers (particularly the gravity filtration dispensing systems) to economically disadvantaged countries.

In light of the foregoing, it should be appreciated that the present invention significantly advances the art by providing dispensing systems that can efficiently employ concentrated forms of soap, whether as solid concentrated soap or liquid concentrated soap. While particular embodiments of the invention have been disclosed in detail herein, it should be appreciated that the invention is not limited thereto or thereby inasmuch as variations on the invention herein will be readily appreciated by those of ordinary skill in the art.

The invention claimed is:

1. A soap dispensing system for personal hygiene comprising:

a water supply that provides water to the system;

a sanitary soap cartridge unit including:

a soap conduit, a soap outlet, and a soap chamber communicating with said soap conduit and holding concentrated soap;

a rinse water outlet;

a rinse water conduit; and a flow controller that controls the flow of water provided by the water supply, wherein, in a soap dispensing operation, said flow controller causes the water to flow to dissolve or dilute concentrated soap from said soap chamber to create a less concentrated soap and deliver said less concentrated soap to said soap outlet through said soap conduit, and, in a water dispensing operation, said flow controller causes the water to flow through said rinse water conduit to deliver rinse water to said rinse water outlet, said rinse water conduit and said soap conduit being separate and distinct such that the rinse water conduit never carries soap, said sanitary soap cartridge unit being disposable such that said soap conduit, said soap outlet and said soap chamber, which become wetted with soap during a soap dispensing operation, may be periodically disposed of by disposing of said sanitary soap cartridge unit.

2. The soap dispensing system of claim 1, further comprising a cartridge water delivery conduit, wherein, during said soap dispensing operation, said flow controller permits the water to flow to said disposable sanitary soap cartridge unit through said cartridge water delivery conduit.

3. The soap dispensing system of claim 2, further comprising a backflow valve in said cartridge water delivery conduit.

4. The soap dispensing system of claim 1, wherein the concentrated soap is a solid soap and said soap chamber of said disposable sanitary soap cartridge unit holds said solid block, said soap chamber having a chamber inlet to which the water is delivered during a soap dispensing operation.

5. The soap dispensing system of claim 4, wherein said soap chamber includes a chamber outlet communicating with said soap conduit such that water delivered to said soap chamber through said chamber inlet flows over said solid soap, dissolving a portion thereof, and carries that dissolved soap to said soap conduit through said chamber outlet.

6. The soap dispensing system of claim 5, wherein said solid soap is a porous block of soap.

7. The soap dispensing system of claim 1, further comprising a dip tube, wherein the concentrated soap is a liquid soap and said soap chamber of said disposable sanitary soap cartridge unit holds said liquid soap, said soap chamber communicating with said soap conduit through said dip tube.

8. The soap dispensing system of claim 7, wherein said soap conduit includes a section of varying diameter, said dip tube fluidly communicating with said soap conduit at said section of varying diameter, and, during a soap dispensing operation, water is delivered to said soap conduit and flows past said dip tube at said section of varying diameter and draws a portion of said liquid soap into said soap conduit by a venturi effect.

9. The soap dispensing system of claim 1, further comprising a faucet, said faucet including a receptacle receiving (a) said disposable sanitary soap cartridge unit, (b) at least a portion of said rinse water conduit, and (c) said rinse water outlet.

10. The soap dispensing system of claim 1, wherein said water supply is a public water supply.

11. The soap dispensing system of claim 1, wherein said water supply is provided by a gravity-fed water filtration system.

12. A soap dispensing system for personal hygiene comprising:

a water supply that provides water to the system;

a soap outlet, a rinse water outlet;

a soap conduit;

a rinse water conduit;

a soap chamber communicating with said soap conduit and holding concentrated powdered soap;

a dosing valve; and a flow controller that controls the flow of water provided by the water supply, wherein, in a soap dispensing operation, said flow controller causes the water to flow to dissolve or dilute concentrated soap from said soap chamber to create a less concentrated soap and deliver said less concentrated soap to said soap outlet through said soap conduit, and, in a water dispensing operation, said flow controller causes the water to flow through said rinse water conduit to deliver rinse water to said rinse water outlet, said rinse water conduit and said soap conduit being separate and distinct such that the rinse water conduit never carries soap, wherein said soap chamber communicates with said soap conduit through said dosing valve mechanism.

13. The soap dispensing system of claim 12, wherein said soap conduit includes an inlet to which the water is delivered during a soap dispensing operation.

14. The soap dispensing system of claim 13, wherein, during a soap dispensing operation, water is delivered to said soap conduit through said inlet, and said dosing valve mechanism deposits a portion of said powdered soap into said conduit to be dissolved and carried to said soap outlet by the water.

* * * * *